US009379498B2

(12) United States Patent
Kaneko et al.

(10) Patent No.: US 9,379,498 B2
(45) Date of Patent: Jun. 28, 2016

(54) COAXIAL CONNECTOR WITH IMPROVED IMPEDANCE CHARACTERISTICS

(71) Applicant: Hirose Electric Co., Ltd., Tokyo (JP)

(72) Inventors: Tsubasa Kaneko, Tokyo (JP); Takashi Sawai, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/607,157

(22) Filed: Jan. 28, 2015

(65) Prior Publication Data

US 2015/0222061 A1 Aug. 6, 2015

(30) Foreign Application Priority Data

Feb. 6, 2014 (JP) ..... 2014-021311

(51) Int. Cl.
*H01R 12/00* (2006.01)
*H01R 24/50* (2011.01)
*H01R 24/44* (2011.01)

(52) U.S. Cl.
CPC ..... *H01R 24/50* (2013.01); *H01R 24/44* (2013.01)

(58) Field of Classification Search
CPC ..... H01R 2103/00; H01R 24/46; H01R 24/50
USPC ..... 439/63, 581
See application file for complete search history.

(56) References Cited

U.S. PATENT DOCUMENTS 5,618,205 A * 4/1997 Riddle ..... H01P 5/085 333/260
8,616,898 B2 * 12/2013 Lee ..... H01R 12/7047 439/63
8,647,128 B2 * 2/2014 Sykes ..... H01R 24/44 439/578
2001/0034143 A1 * 10/2001 Annequin ..... H01R 13/74 439/63
2009/0137133 A1 * 5/2009 Gou ..... H01R 24/50 439/63

FOREIGN PATENT DOCUMENTS

JP 2003-178844 A 6/2003

* cited by examiner

*Primary Examiner* — Phuong Dinh
(74) *Attorney, Agent, or Firm* — Kubotera & Associates, LLC

(57) ABSTRACT

A coaxial connector includes an outer conductive member including a board mounting portion and a main body portion; an insulation member disposed in the outer conductive member; a central conductive member supported with the insulation member; and a metal member disposed in the outer conductive member below the insulation member. The metal member includes a through hole for retaining the central conductive member therein. The central conductive member is situated in the through hole away from an inner surface of the through hole by a first distance at an upper portion of the through hole. The central conductive member is situated in the through hole away from the inner surface of the through hole by a second distance at a lower portion of the through hole. The first distance is greater than the second distance.

9 Claims, 13 Drawing Sheets

COAXIAL CONNECTOR WITH IMPROVED IMPEDANCE CHARACTERISTICS

BACKGROUND OF THE INVENTION AND RELATED ART STATEMENT

The present invention relates to a coaxial connector. In particular, the present invention relates to a coaxial connector with improved impedance characteristics.

Patent Reference has disclosed a conventional coaxial connector. FIG. 13 shows a configuration of the conventional coaxial connector.

Patent Reference: Japanese Patent Application Publication No. 2003-178844

As shown in FIG. 13, the conventional coaxial connector includes a first outer conductive member 101, an insulating body 102, a second outer conductive member 103, and a central conductive member pin 105. The conventional coaxial connector is to be secured on a printed circuit board with screws 116 through screw holes 114 provided on a bottom surface of the first outer conductive member 101. The central conductive member pin 105 can elastically contact with a circuit pattern 112 in a stable state via a rotatable spherical structure 107.

In these days, there is a demand for a coaxial connector for inspection, which can be secured on a circuit board surface at a high density with screws and can exhibit satisfactory impedance characteristics relative to high-frequency signals. In the conventional coaxial connector disclosed in Patent Reference, however, it is necessary to have a complicated structure, in which the central conductive member pin 105 is provided with elasticity in a vertical direction, and a rotatable spherical structure is disposed at an end of the central conductive member pin 105. In addition, in case of standard products such as typical BNC and SMB, when the conventional coaxial connector is used to process high-frequency signals higher than 3 GHz, impedance mismatch easily tends to occur, thereby deteriorating the impedance characteristics.

In view of the problems described above, an object of the present invention is to provide a coaxial connector with improved impedance characteristics.

Further objects and advantages of the present invention will be apparent from the following description of the present invention.

SUMMARY OF THE PRESENT INVENTION

In order to achieve the above object, based on knowledge that impedance characteristics are determined by a ratio between an outer diameter of the central conductive member and an inner diameter of the outer conductive member, it is assumed that it could be possible to improve the impedance characteristics by adjusting the ratio. Here, the impedance characteristics have close relationship with insertion loss and a voltage standing wave ratio (VSWR), so that those characteristics are also taken into consideration. After various simulations, it is confirmed that the impedance characteristics can be improved with the following configurations.

According to a first aspect of the present invention, a coaxial connector includes an outer conductive member; an insulation member; a central conductive member; and an annular metal member. The outer conductive member includes a board mounting portion and a cylindrical main body portion, which is vertically provided along an axial direction from the board mounting portion. The outer conductive member has a through hole, with which the board mounting portion and the main body portion are connected to each other. The insulation member is to be accommodated inside of the through hole of the outer conductive member.

According to the first aspect of the present invention, the central conductive member is supported by the insulation member, and is to be disposed inside of the through hole of the outer conductive member along the axial direction. The annular metal member has a facing surface that faces at least a part of the insulation member in a surface that extends in a radial direction perpendicular to the axial direction, and is to be accommodated in the through hole of the outer conductive member on a side of the board mounting portion relative to the insulation member. The central conductive member supported by the insulation member penetrates a through hole of the annular metal member along the axial direction, and has an air layer that expands in the radial direction between an outer surface of the central conductive member and an inner circumferential surface of the through hole. The diameter of the air layer of the annular metal member near the facing surface is configured to be larger than a diameter of the air layer of the annular metal member at a position that is away from the facing surface.

According to a second aspect of the invention, the coaxial connector may include an annular step portion on an inner circumferential surface of the through hole of the annular metal member. The annular step portion extends from the facing surface towards a surface opposite to the facing surface. As a result, the diameter of the air layer of the annular metal member near the facing surface can be set larger than the diameter of the air layer of the annular metal member at a position that is away from the facing surface.

According to a third aspect of the invention, the coaxial connector may include a plurality of step portions on the inner circumferential surface of the through hole of the annular metal member. The step portions extend from the facing surface towards the surface opposite the facing surface. As a result, the diameter of the air layer of the annular metal member near the facing surface is set larger than the diameter of the air layer of the annular metal member at a position that is away from the facing surface.

According to a fourth aspect of the invention, the coaxial connector may include a tapered portion on the inner circumferential surface of the through hole of the annular metal member. The tapered portion extends from the facing surface towards a surface opposite the facing surface. As a result, the diameter of the air layer of the annular metal member near the facing surface can be set larger than the diameter of the air layer of the annular metal member at a position that is away from the facing surface. In addition, the diameter of the air layer at the tapered portion can be set so as to become larger from a side that is away from the facing side to a side that is close to the facing surface.

According to a fifth aspect of the invention, the coaxial connector may include a plurality of groove portions formed in the facing surface. The groove portions extend from a center of the through hole of the annular metal member towards outside of the annular metal member. As a result, at least at the groove portions, the diameter of the air layer of the annular metal member near the facing surface can be set larger than the diameter of the air layer of the annular metal member at a position that is away from the facing surface.

According to a sixth aspect of the invention, in the coaxial connector, the groove portions may be provided at a plurality of positions radially around the center of the through hole of the annular metal member. In addition, a plurality of generally fan-shaped portions may be formed on the facing surface of the annular metal member.

According to a seventh aspect of the invention, in the coaxial connector, the central conductive member is preferably provided to protrude more than the annular metal member in a direction from the main body portion to the board mounting portion. The annular metal member is preferably provided to protrude more than the board mounting portion in a direction from the main body portion towards the board mounting portion.

According to an eighth aspect of the invention, in the coaxial connector, the annular metal member is preferably plated with a material of higher conductivity than the material of the annular metal member.

According to a ninth aspect of the invention, in the coaxial connector, the through hole of the outer conductive member may include a engaging portion, which engages with the insulation member accommodated in the through hole of the outer conductive member, and another engaging portion, which engages with the annular metal member accommodated in the through hole of the outer conductive member.

As described above, according to the present invention, it is achievable to provide a coaxial connector with improved impedance characteristics.

DETAILED DESCRIPTION OF THE PREFERRED EMBODIMENTS

Hereunder, an embodiment of the present invention will be described with reference to the accompanying drawings.

[Configuration of a Coaxial Connector]

Figure 1:
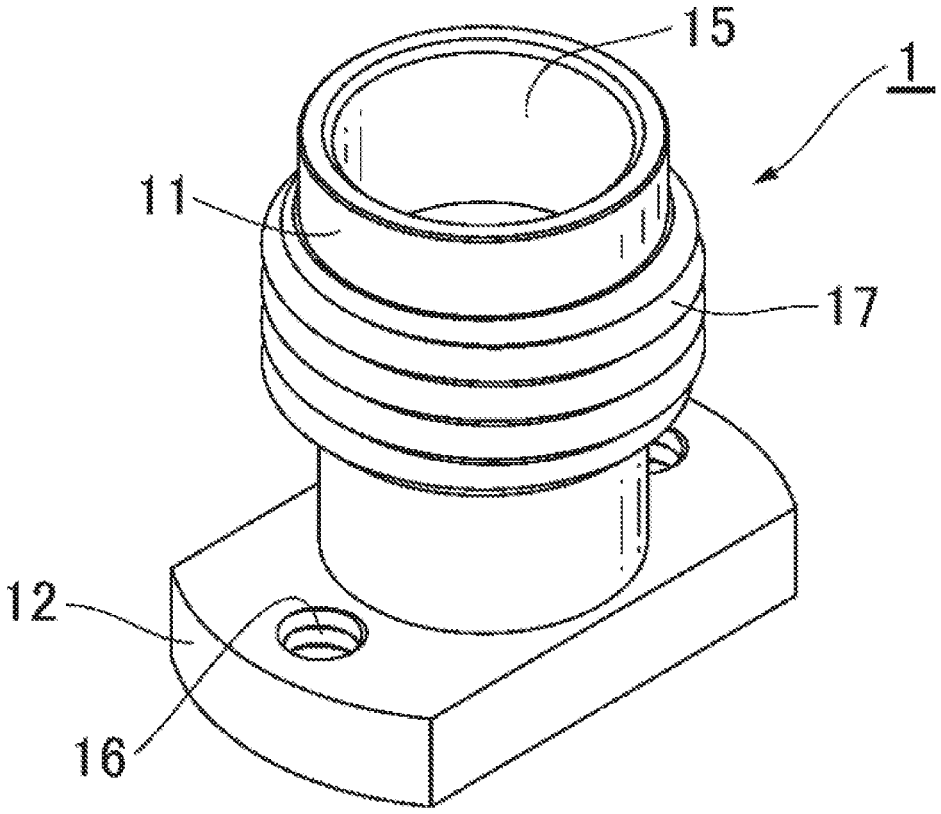
FIG. 1 is a perspective view showing an outer appearance of a coaxial connector used in simulations.
Figure 2:
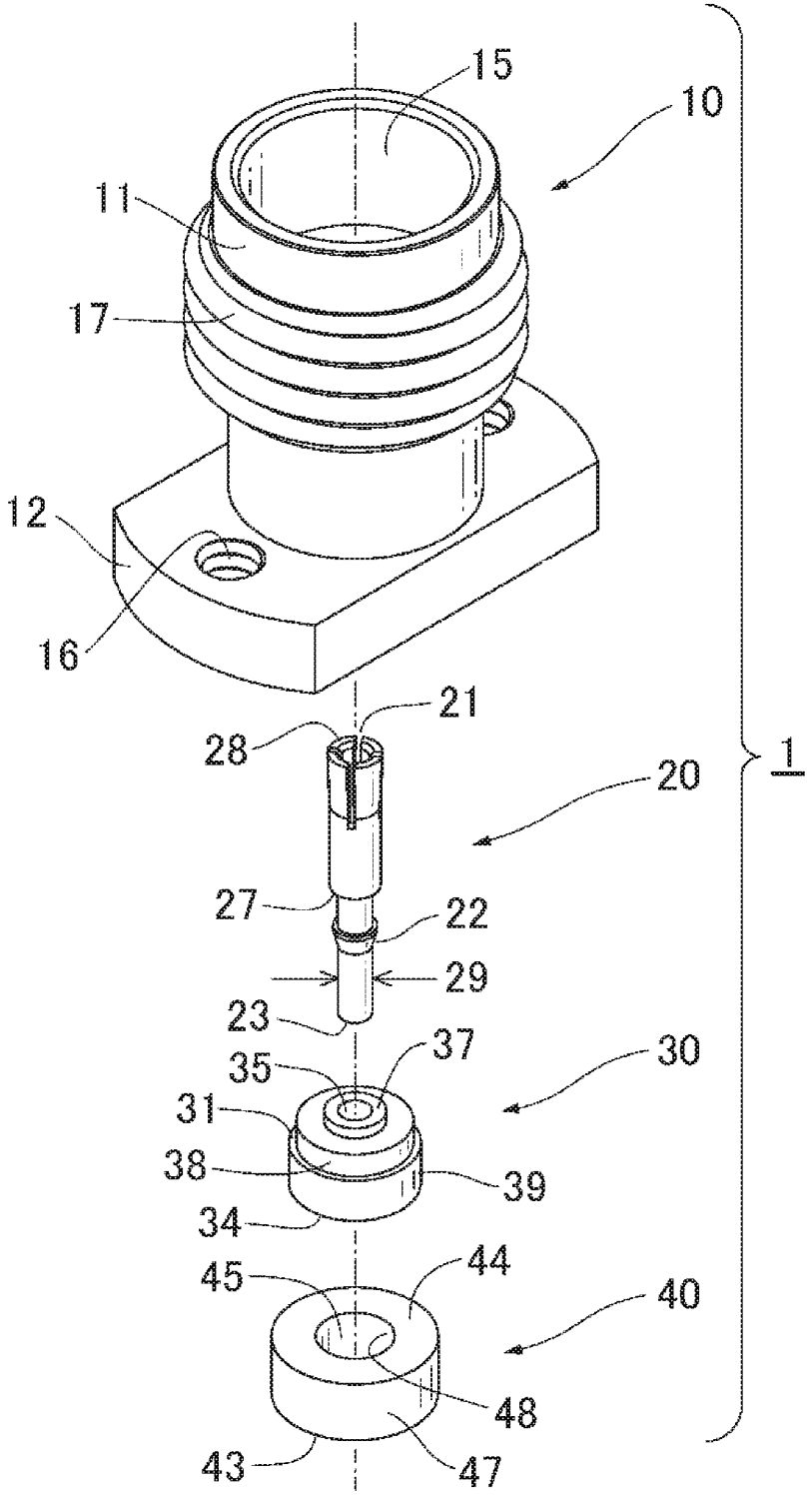
FIG. 2 is an exploded perspective view showing the coaxial connector used in the simulations.
Figure 3:
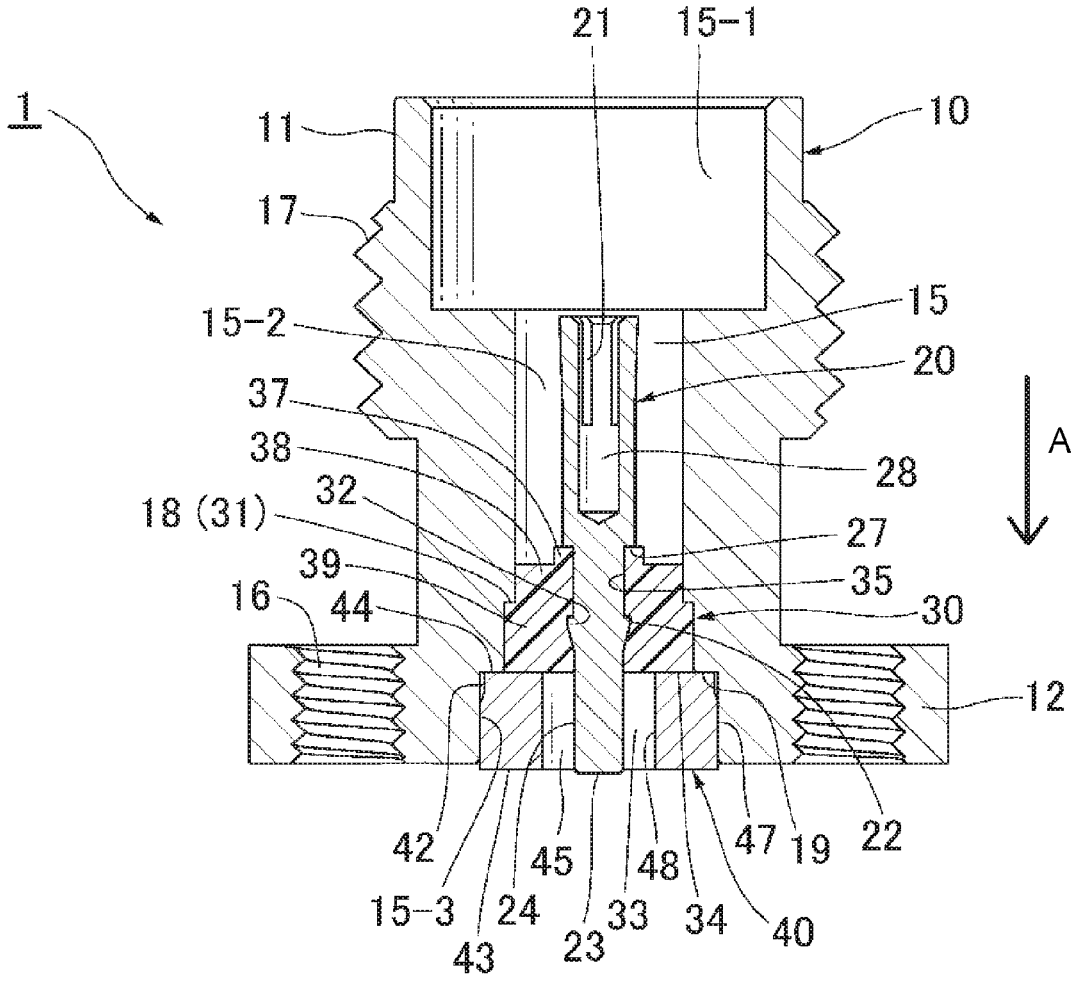
FIG. 3 is a vertical sectional view showing the coaxial connector used in the simulations.

A simulation was conducted to study influences of a configuration of a coaxial connector at and around an interface between an annular metal member and an insulation member, which face each other on impedance characteristics of the coaxial connector. In the simulations, a coaxial connector 1 having a configuration shown in FIGS. 1 through 3 was used. FIG. 1 is a perspective view of outer appearance of the coaxial connector 1. FIG. 2 is an exploded perspective view of the coaxial connector 1. FIG. 3 is a vertical sectional view of the coaxial connector 1. Here, the coaxial connector 1 shown in those figures is not a conventional one, but the one invented by the present inventors upon conducting the simulations.

The coaxial connector 1 can be used, for example, as a coaxial connector for inspection, which is to be vertically screwed on an evaluation board surface for high-speed transmission. With advancement in achieving higher speed transmission of higher frequency signals, the coaxial connector requires a connector for an evaluation board, to which it is possible to send coaxial signals of high frequency at high density. The coaxial connector 1 is suitable as such a connector for an evaluation board. Here, the use of the coaxial connector 1 is not limited to the one for an evaluation board, and of course. The coaxial connector 1 can be also used for general connections.

The coaxial connector 1 mainly includes an outer conductive member 10, a central conductive member 20, an insulation member 30, and an annual metal member 40.

The outer conductive member 101 may be produced, for example, by cutting metal such as stainless steel and brass. The outer conductive member 10 mainly includes a board mounting portion 12 and a main body portion 11. The board mounting portion 12 is a portion to be mounted on a board (not illustrated) and is formed as a flat body having a certain thickness.

On left and right sides of the board mounting portion 12, there are provided screw holes 16 that are through holes provided to secure the outer conductive member 10 on a board. With those screw holes 16, it is possible to vertically secure the annular metal member 40, which is for securing the insulation member 30 on a surface of the mounting board, on a surface of the mounting board as a secure grounding surface of the outer conductive member 10. The main body portion 11 is a portion that is vertically provided in an axial direction from the board mounting portion 12, and has a cylindrical shape as a whole. On an insertion side of a mating terminal of the main body portion 11, there are provided screw portions 17 that enable connection to mating terminals (not illustrated) by screws.

On the board mounting portion 12 and the main body portion 11, there is provided a through hole 15 that is continuous therebetween. The through hole 15 includes a large-diameter portion 15-1, to which a part of a mating terminal is inserted, a small diameter portion 15-2, which is formed by cutting so as to have the diameter thereof gradually small from the board mounting surface and is for disposing the central conductive member 20 and the insulation member 30 therein, and a medium-sized diameter portion 15-3 to dispose the annular metal member 40 therein.

The insulation member 30 may be produced, for example, from resin. The insulation member 30 can include, for example, three coaxial ring portions, i.e., a small-diameter ring 37, a medium-diameter ring 38, and a large diameter ring 39. Alternatively, the insulation member 30 can have a shape of those rings piled up in the order. Each ring includes a holding hole 35 having a certain diameter, so that all those rings form a through hole. The insulation member 30 is inserted to be accommodated in the small diameter hole 15-2 of the through hole 15, which is continuous between the board mounting portion 12 and the main body portion 11, via the medium diameter portion 15-3 from the board mounting side of the outer conductive member 10.

In order to position the insulation member 30 to a specified position of the through hole 15, it is possible to use a flange 31 formed between the medium diameter ring 38 and the large diameter ring 39 of the insulation member 30. It is also possible to restrict excess press-in of the insulation member 30 in the through hole 15 by having the flange 31 abut against the engaging step portion (engaging portion) 18 provided in the through hole 15.

The central conductive member 20 can be also produced, from example, by fabricating sheet metal of phosphor bronze. On a side for insertion of a mating terminal, there is formed a plurality of elastic arms 28 to elastically contact with the mating terminal. The elastic arms 28 are formed by having slotted end portions 21. The central conductive member 20 is supported by a holding hole 35 of the insulation member 30.

In order to position the central conductive member 20 at a specified position of the holding hole 35, there are provided an annular flange 27 and a slanted protrusion 22 near a middle part of the central conductive member 20. When the central conductive member 20 is inserted in the holding hole 35 of the insulation member 30 from a side near the small diameter ring 37, the annular flange 27 abuts an upper surface of the small diameter ring 37, and the slanted protrusion 22 is secured in a dent 32 of the insulation member 30. With the configuration, the central conductive member 20 is supported by the insulation member 30, and at the same time, is disposed inside of the through hole 15 of the outer conductive member 10 along the axial direction via the insulation member 30.

The annular metal member 40 has a ring shape, in which a through hole 45 having a certain diameter is provided at a center thereof. The annular metal member 40 can be produced, for example, by cutting metal such as stainless steel and bronze. In order to increase conductivity, it is preferable to apply plating on a side of a mounting surface of the annular metal member 40 or the whole thereof with a highly conductive material such as metal plating and silver plating, also in view of electrical performance and cost reduction. The annular metal member 40 is inserted to be accommodated in the medium diameter portion 15-3 on a board-mounting side of the outer conductive member 10 on a board-mounting side relative to the insulation member 30.

In order to position the annular metal member 40 to a specified position of the through hole 15, there is provided an engaging step portion (engaging portion) 19 on the through hole 15. On to the engaging portion 19, one surface 44 of the annular metal member 40, which is present within a surface perpendicular to the axial direction, is disposed so as to face at least a part (the facing surface 34) of the insulation member 30. It is also possible to restrict excess press-in of the annular metal member 40 to the through hole 15 by abutting the annular metal member 40 to the engaging step portion (engaging portion) 19.

In order to make smooth insertion of the annular metal member 40 into the outer conductive member 10, it is also possible to provide a small annular chamfered portion 42 on an edge of an outer surface 47 of the annular metal member 40 on a side for inserting a mating terminal. With the chamfered portion 42, an outer diameter of the one surface 44 of the annular metal member 40 is slightly smaller than an outer diameter of the facing surface 34 of the annular metal member 40, but it is still larger than the outer diameter of the insulation member 30.

Moreover, the diameter of the through hole 45 of the annular metal member 40 is larger than the outer diameter of the central conductive member 20, but it is smaller than the outer diameter of the insulation member 30. With the dimensional relation, it is achievable to prevent the insulation member 30 from coming off by disposing the annular metal member 40 so as to face at least a part (facing surface 34) of the insulation member 30.

The coaxial connector 1 is assembled by inserting the insulation member 30 in the small diameter portion 15-2 of the through hole 15 of the outer conductive member 10, then inserting the annular metal member 40 in the medium diameter portion 15-3, and lastly inserting the central conductive member 20 into the holding hole 35 of the insulation member 30 accommodated in the through hole 15.

After assembling, the central conductive member 20, which is supported by the holding hole 35 of the insulation member 30, is disposed, having the through hole 45 be penetrated along the axial direction (a direction along the arrow "A" in FIG. 3). With the central conductive member 20 being disposed in the through hole 45, there is formed an air layer 33, which extends in a radial direction being perpendicular to the axial direction, between the outer surface 24 of the central conductive member 20 and the inner circumferential surface 48 of the through hole 45.

Here, the central conductive member 20 is preferably in a state of protruding for the same amount as or slightly less than the annular metal member 40 in the direction from the main body portion 11 to the board mounting portion 12 along the axial direction (direction indicated as the arrow "A" in FIG. 3). In addition, the annular metal member 40 is preferably provided in a state of protruding slightly more than the board mounting portion 12 in the direction from the main body portion 11 to the board mounting direction (the direction "A").

When the central conductive member 20 and the annular metal member 40 are in those states, even if the board mounting portion 12 is secured without using solder, e.g. by screwing onto a board surface, the mounting surface 23 of the central conductive member 20 surely contacts with the board. Similarly, the mounting surface of the annular metal member 40 also surely contacts with the board.

[Simulation Software]

Simulation software used in the invention was ANSYS HFSS Ver. 15, which is common software and can be easily obtained.

[Simulation Method]

Figure 4:
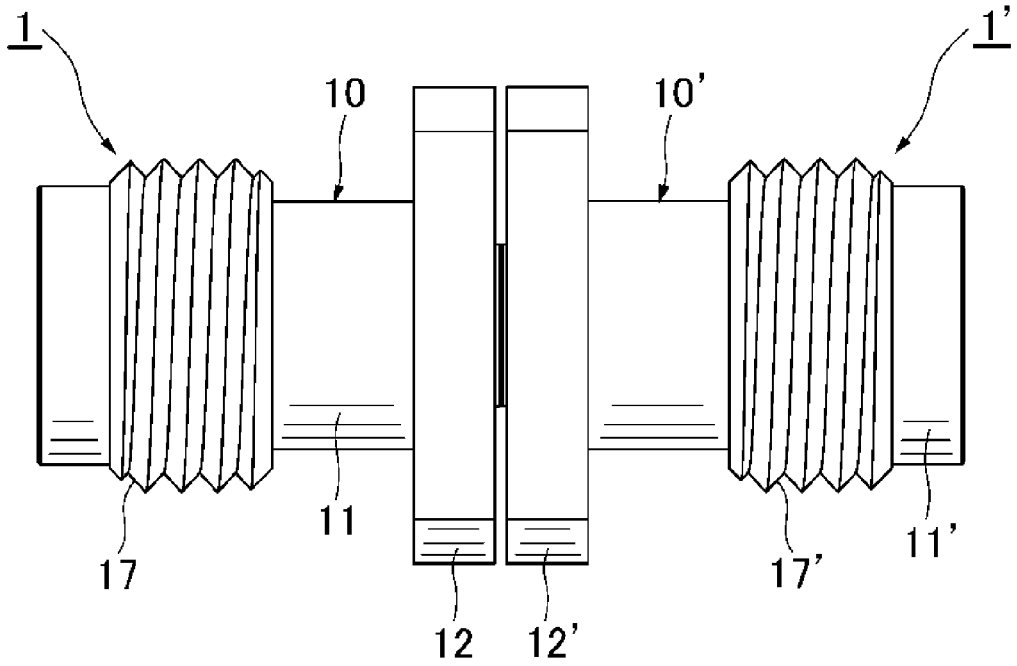
FIG. 4 is a view showing an arrangement of the coaxial connector used in the simulations.

Two coaxial connectors shown in FIGS. 1 through 3 were used. As shown in FIG. 4, the two coaxial connectors 1 and 1' were disposed so as to have the mounting portions 12 and 12' of the outer conductive members 10 and 10' face each other. Here, as described above, the central conductive member 20 is provided in a state of protruding more than the annular metal member 40 in a direction from the main body portion 11 to the board mounting portion 12 (the direction "A" in FIG. 3).

At the same time, the annular metal member 40 is provided in a state of protruding more than the board mounting portion 12 in the direction from the main body portion 11 to the board mounting portion 12 (the direction "A"). Therefore, the portions that face each other when the coaxial connectors 1 and 1' are mechanically secured with screws (not illustrated) are electrically connected to each other. More specifically, the mounting surface 43 of the annular metal member 40 of one coaxial connector 1 is connected to the mounting surface 43' of the annular metal member 40' of the other coaxial connector 1'. The mounting surface 23 of the central conductive member 20 of the one coaxial connector 1 is connected to the mounting surface 23' of the central conductive member 20' of the other coaxial connector 1'.

Here, the outer conductive member 10 and the annular metal member 40 of the one coaxial connector 1 are electrically connected. Moreover, the outer conductive member 10' and the annular metal member 40' of the other coaxial connector 1' are electrically connected. Therefore, the outer conductive member 10 and the outer conductive member 10' are electrically connected, similarly to the connection between the annular metal member 40 and 40'.

To the coaxial connectors 1 and 1' disposed as described above, connected are coaxial cables (not illustrated), which are respectively connected to input and an output of a network analyzer. Then, to the one coaxial connector 1, electric signals of up to 50 GHz were input. Upon this input, based on that impedance characteristics are determined by a ratio between the outer diameter 29 of the central conductive member 20 and the inner diameter 49 of the annular metal member 40, it is anticipated that it may be possible to improve the impedance characteristics by changing a configuration at and around an interface between facing annular metal member 40 and insulation member 30. Accordingly, we conducted simulations of impedance and insertion loss and voltage standing wave ratio (VSWR) that influences the impedance for annular metal members of various shapes (annular metal members 40*a*-40*e* shown in FIGS. 8(*a*)-8(*b*) to 12(*a*)-12(*b*), which will be described later).

[Simulation Results]

Figure 5:
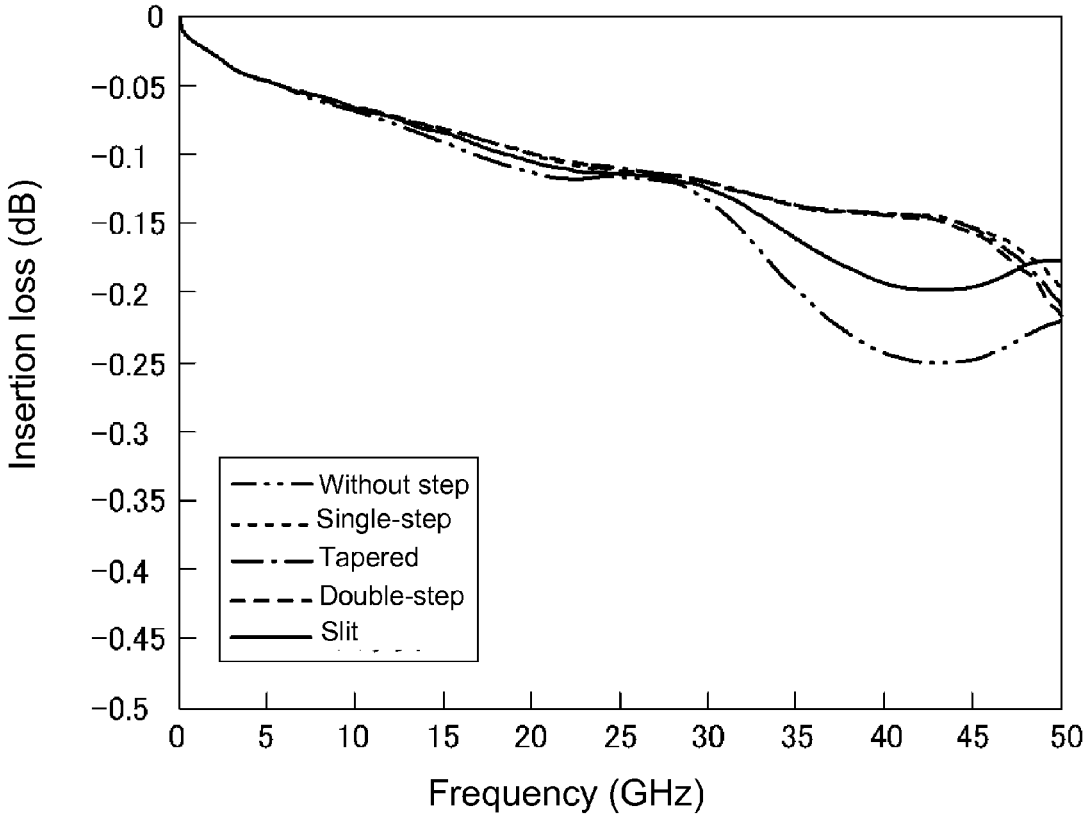
FIG. 5 is a diagram showing simulation results regarding insertion loss.
Figure 6:
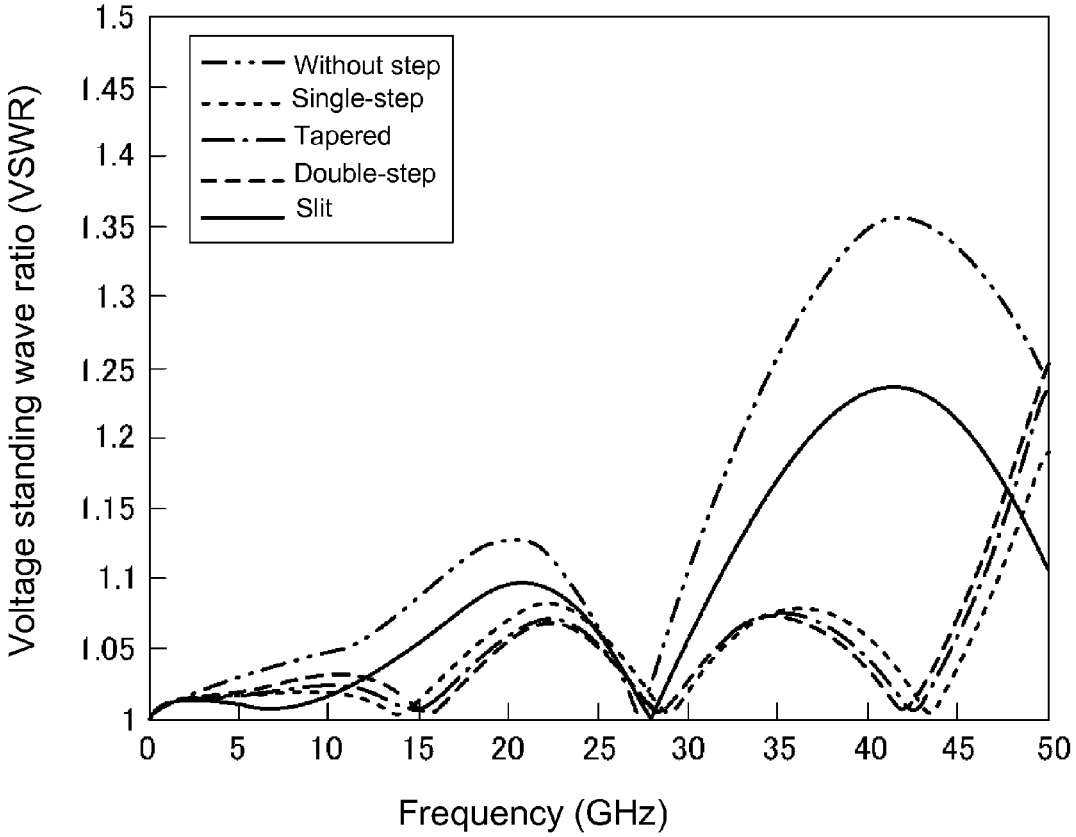
FIG. 6 is a diagram showing simulation results regarding voltage standing wave ratio (VSWR)
Figure 7:
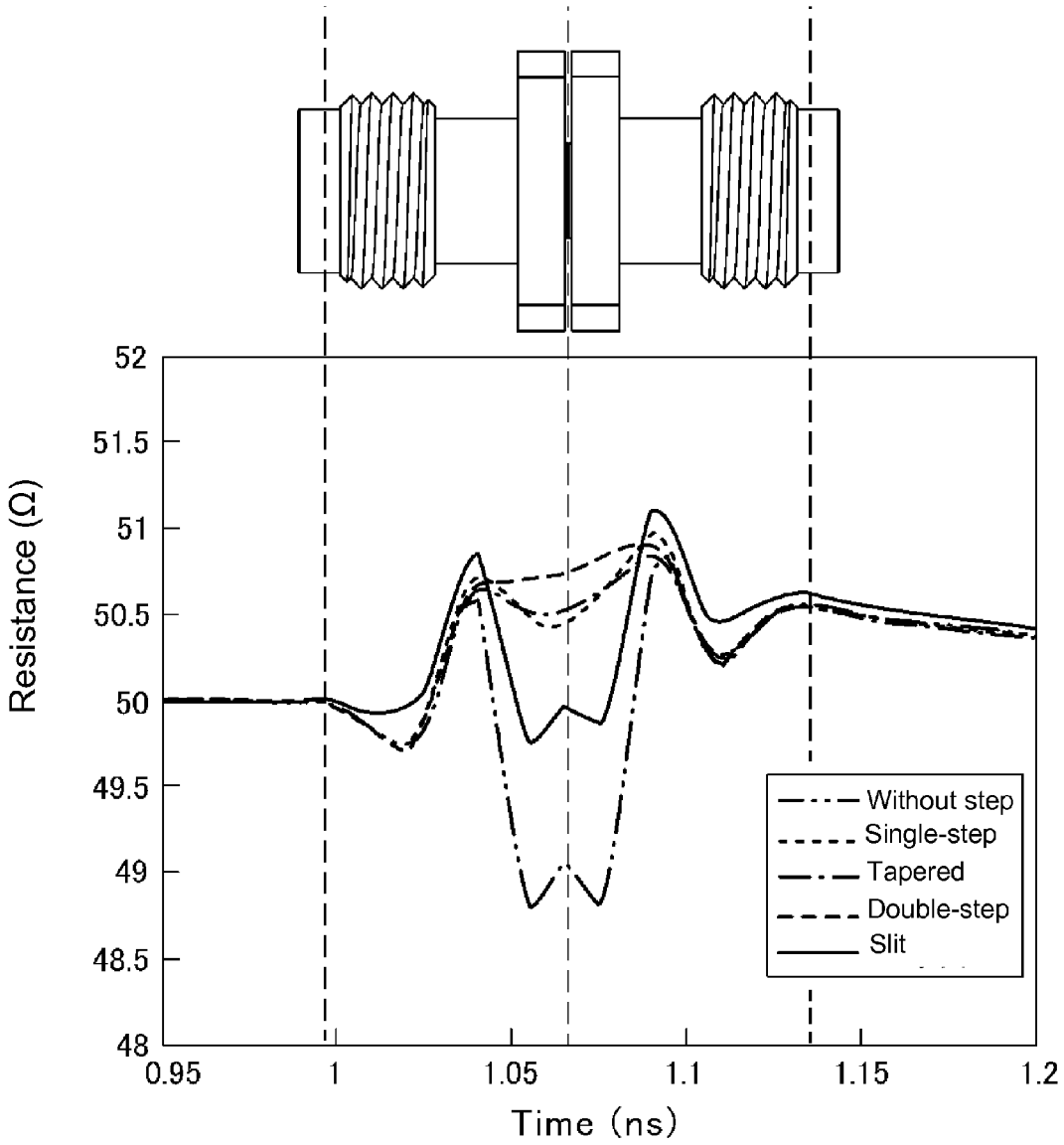
FIG. 7 is a diagram showing simulation results regarding impedance.

Detailed simulation results are shown in FIGS. 5 to 7 only for shapes that gave relatively good results.

FIG. 5 shows simulation results of the insertion loss in all Examples and Comparative Example in one sheet, which were seen in output signals obtained by the other coaxial connector 1' when electrical signals of up to 50 GHZ were input in the one coaxial connector 1. Frequencies (GHz) of up to 50 GHz is taken at the abscissa and the insertion loss (dB) is taken at the ordinate. Obviously, as the insertion loss (dB) is closer to "0", loss is less, so that the value is close to an ideal one as it is closer to "0".

FIG. 6 shows simulation results regarding voltage standing wave ratio (VSWR) in all Examples and Comparative Example in one sheet, and shows signals reflected to the one coaxial connector 1 when electric signals of up to 50 GHZ were input in the one coaxial connector 1. In the diagram, the frequency of up to 50 GHz is taken at the abscissa and a value of standing wave ratio is taken at the ordinate. Obviously, as the voltage standing wave ratio is closer to "1", the reflection is less, so that the value is ideal if the value is closer to "1".

FIG. 7 shows simulation results of impedance in all Examples and Comparative Example in one sheet, which were calculated from output signals obtained in the other coaxial connector 1' when electrical signals of up to 50 GHz were input to the one coaxial connector 1. The abscissa represents time (ns) and the ordinate represents resistance (Ω), respectively. Since a coaxial line of 50Ω is assumed, when the value of impedance in FIG. 7 is closer to 50Ω, the impedance match is more satisfactory. In addition, when the insertion loss is even smaller and the voltage standing wave ratio is close to "1", the impedance matching collapses. Therefore, needless to say, in this case, the impedance characteristics are definitely good.

Here, there is no obvious relation with parts of the coaxial connectors 1 and 1' for waveform that indicates the insertion loss in FIG. 5 and the waveform showing the voltage standing wave ratio in FIG. 6. On the other hand, between the waveform showing the impedance and parts of the coaxial connectors 1 and 1', there is some correlation recognized, although it is impossible to strictly compare since there is a difference between electrical length and a physical length. For this reason, for FIG. 7, we showed parts of the coaxial connectors 1 and 1' that correspond to the waveforms along with the waveforms showing impedance for convenience, and we revealed the correlation therebetween.

Figure 8:
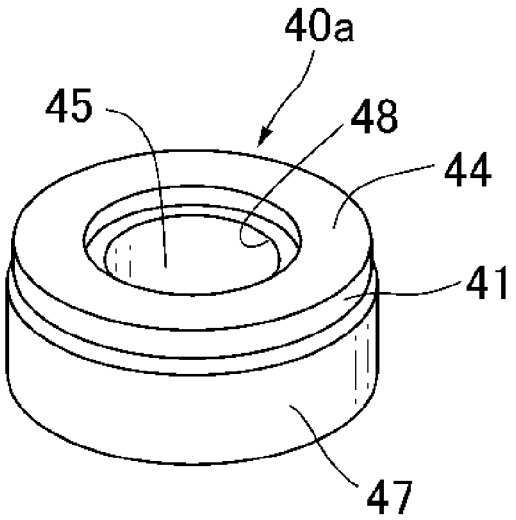
FIGS. 8(*a*) and 8(*b*) are views showing a configuration of a coaxial connector according to Example 1.
Figure 8:
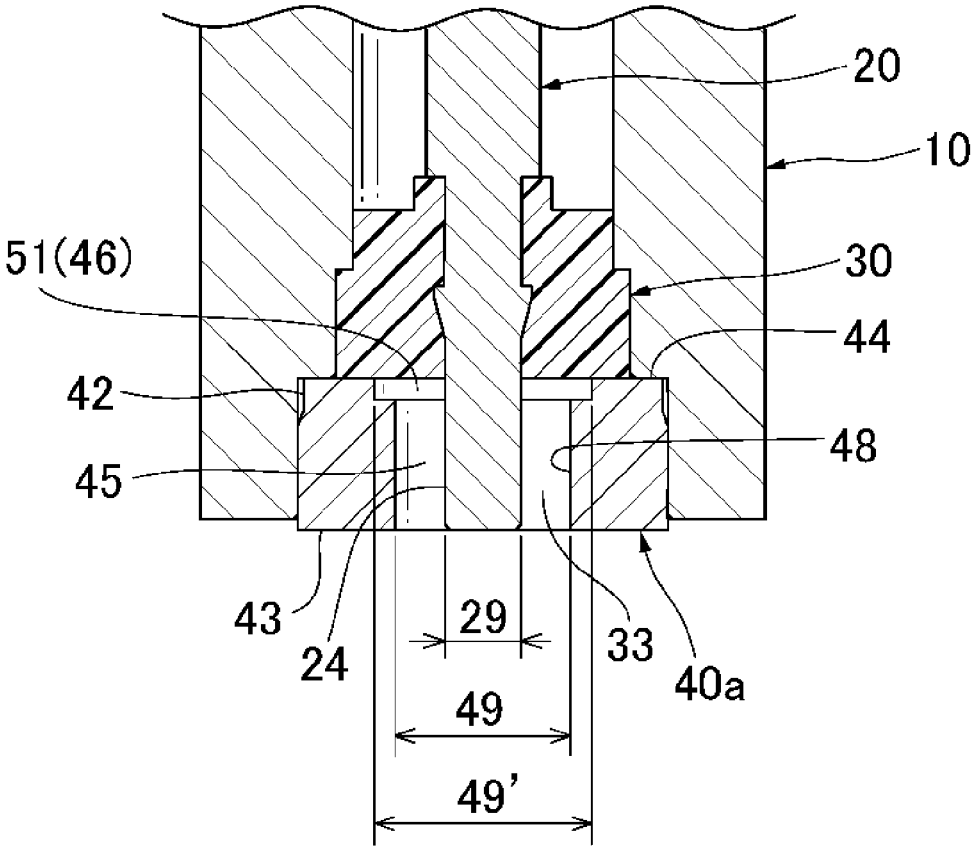

FIGS. 8(*a*)-8(*b*) to 11(*a*)-11(*b*) show portions including the annual metal members 40*a* to 40*d* used in respective Examples, including portions therearound. Furthermore, FIGS. 12(*a*) and 12(*b*) show a portion including the annular metal member 40 used in Comparative Example and a portion therearound.

Figure 12:
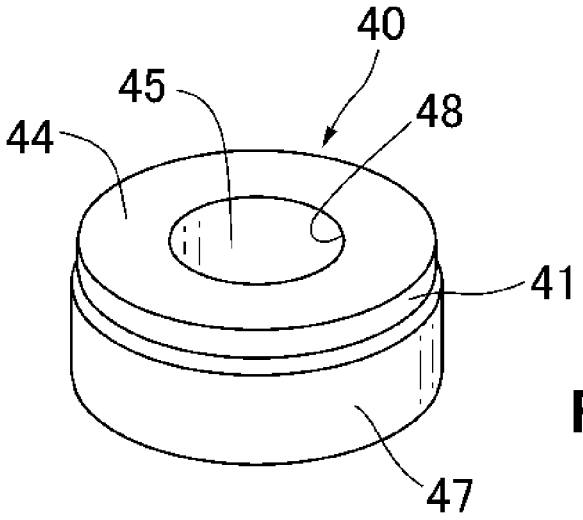
FIGS. 12(*a*) and 12(*b*) are views showing a configuration of a coaxial connector according to Comparative Example.
Figure 12:
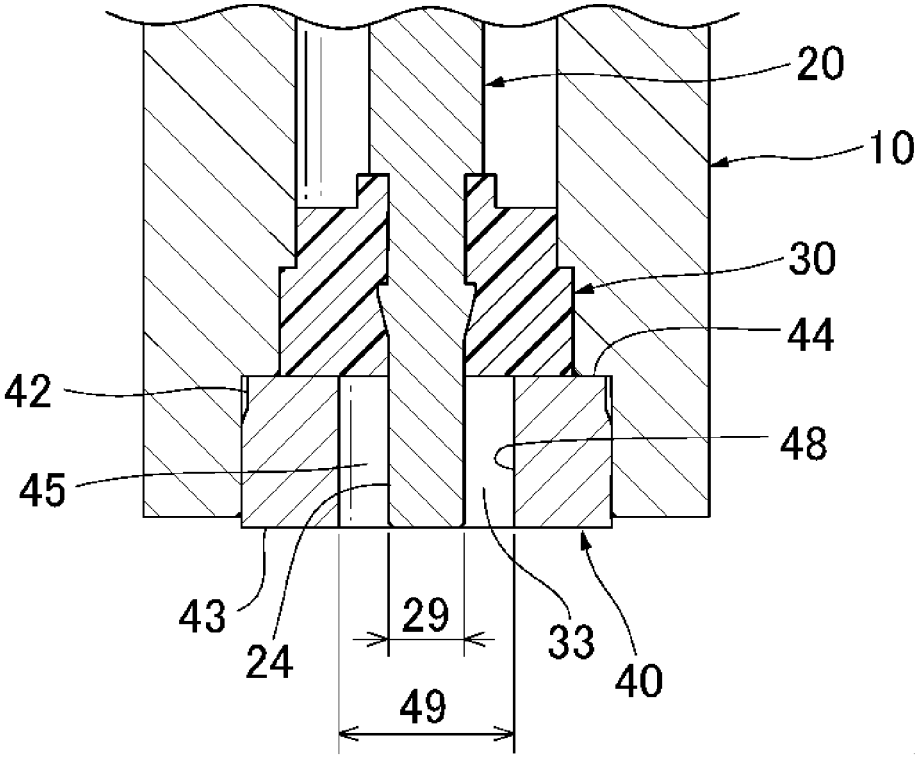
Figure 13:
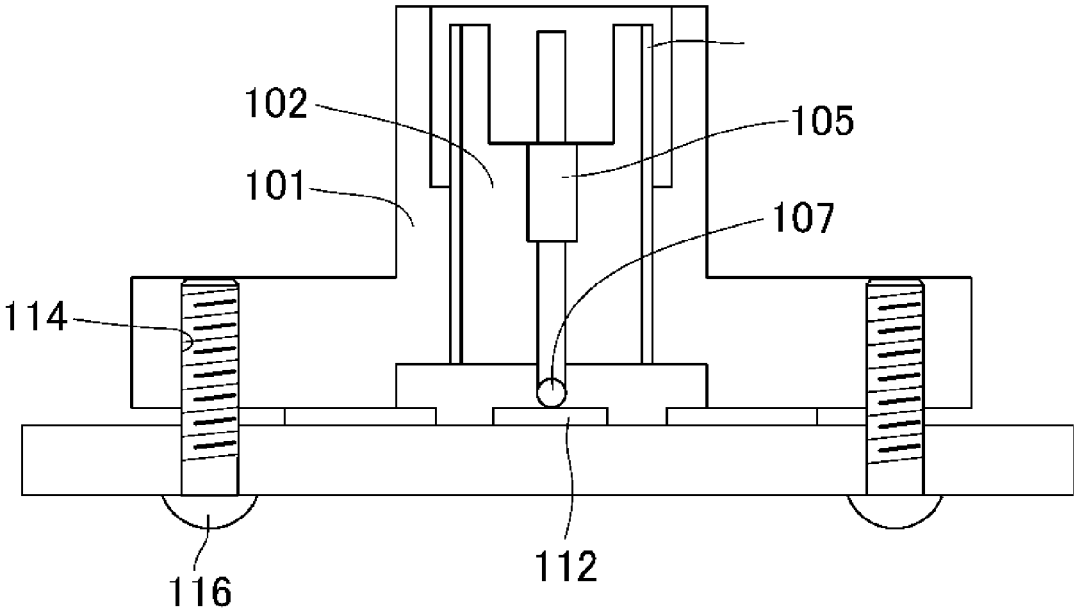
FIG. 13 PRIOR ART
FIG. 13 is a view showing a configuration of a conventional coaxial connector.

As a result of the simulations, from comparison between Examples shown in FIGS. 8(*a*)-8(*b*) to 11(*a*)-11(*b*) and Comparative Example shown in FIGS. 12(*a*) and 12(*b*), it was found that satisfactory simulation results were obtained, when the diameter 49' of the air layer 33 of the annular metal member 40 near the facing surface 44 is set larger than the diameter 49 of the air layer 33 of the annular metal member 40 at a position that is away from the facing surface 44. Here, for convenience, in FIGS. 8(*a*)-8(*b*) to 11(*a*)-11(*b*) (and FIGS. 12(*a*) and 12(*b*)), similar reference numerals to those in FIGS. 1 to 3 are used for members that correspond to members in FIGS. 1 to 3.

Example 1

Single-Step Configuration

Using the annular metal member 40*a* shown in FIG. 8(*a*), simulation was conducted. FIG. 8(*b*) is a partial sectional view that corresponds to FIG. 3, when the annular metal member 40*a* was used. Being different from those shown in FIGS. 1 to 3, in case of the annular metal member 40*a*, there is provided an annular step portion 51 on an inner circumferential surface 48 of the through hole 45, which extends from the facing surface 44 to the mounting surface 43 that is provided opposite the facing surface 44. As a result, the diameter 49' of the air layer 33 of the annular metal member 40*a* near the facing surface 44 is larger than the diameter 49 of the air layer 33 of the annular metal member 40*a* at a position that is away from the facing surface 44.

As shown in FIGS. 5 to 7, in this case, quite better results were obtained for any of the insertion loss, voltage standing wave ration, and impedance, in comparison with the configuration shown in FIGS. 1 to 3, in which the annular step portion is not provided.

Example 2

Double-Step Configuration

Figure 9:
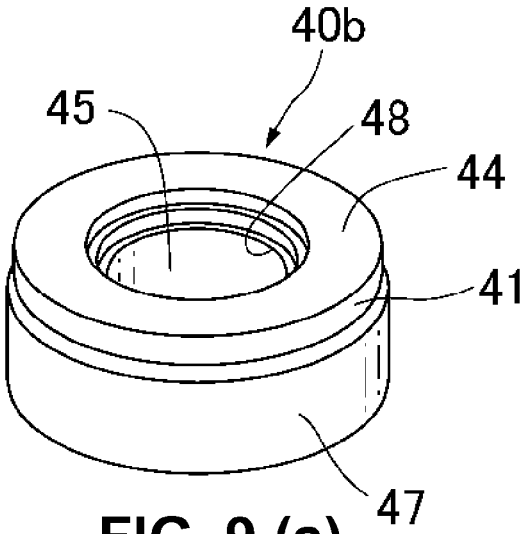
FIGS. 9(*a*) and 9(*b*) are views showing a configuration of a coaxial connector according to Example 2.
Figure 9:
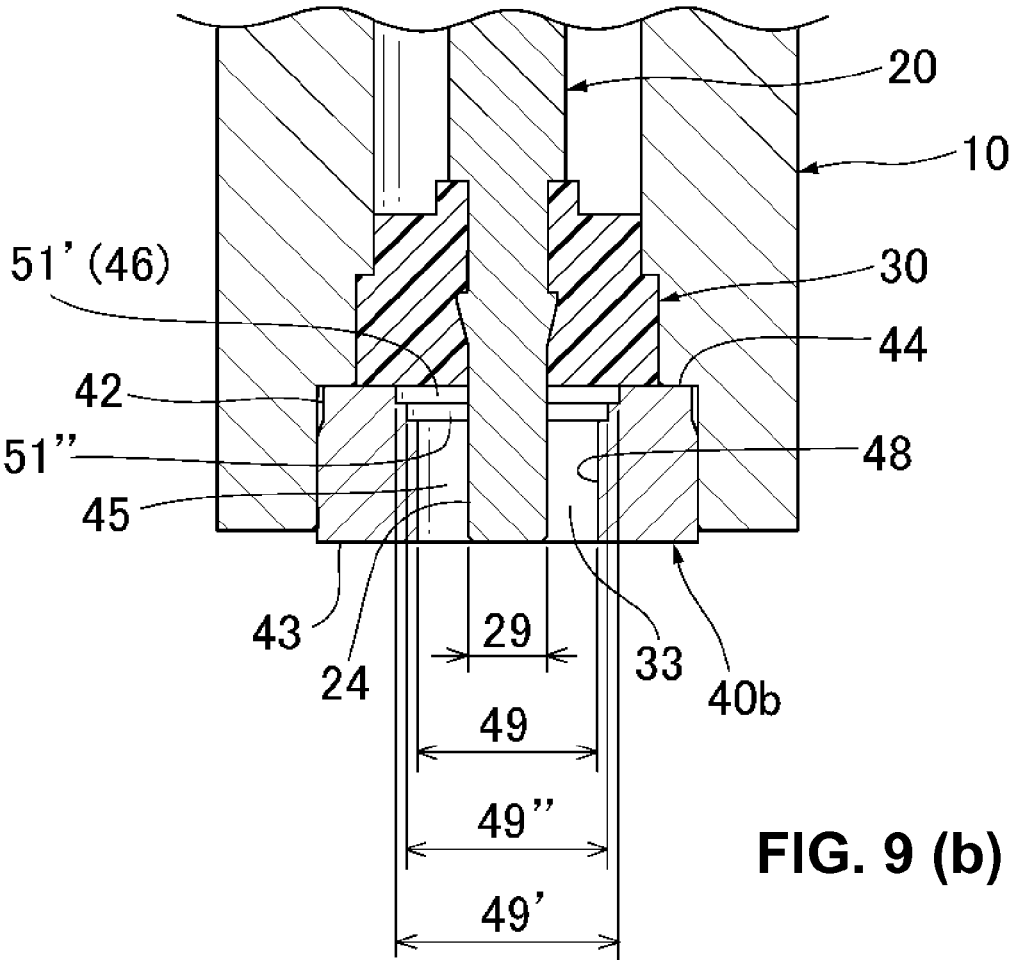

Using the annular metal member 40*b* shown in FIG. 9(*a*), simulation was conducted. FIG. 9(*b*) is a partial sectional view equivalent to FIG. 3 when the annular metal member 40*b* was used. Being different from those shown in FIGS. 1 to 3, the annular metal member 40*b* includes a plurality of the annular step portions (double-step portion in this Example) 51' and 51" on the inner circumferential surface 48 of the through hole 45, which extends from the facing surface 44 to the mounting surface 43 that is provided opposite the facing surface 44. A difference from Example 1 shown in FIGS. 8(*a*) and 8(*b*) is that a plurality of (two in this Example) annular step portions is provided. Here, in the annular step portion 51' and 51", the diameter 49' of the air layer 33 in the annular step portion 51' that is closer to the facing surface 44 is set larger than the diameter 49" of the air layer 33 in the annular step portion 51" that is away from the facing surface 44.

As shown in FIGS. 5 to 7, in this case, similar to the configuration of Example 1, in which the annular step portion 51 has a single-step configuration, results of the insertion loss, voltage standing wave ratio, and impedance are much better than those for the configurations shown in FIGS. 1 to 3. Moreover, in comparison with Example 1, the results were slightly better.

Example 3

Tapered Configuration

Figure 10:
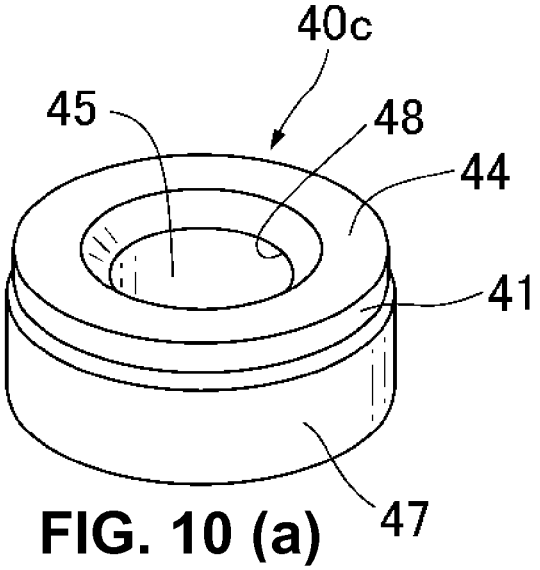
FIGS. 10(*a*) and 10(*b*) are views showing a configuration of a coaxial connector according to Example 3.
Figure 10:
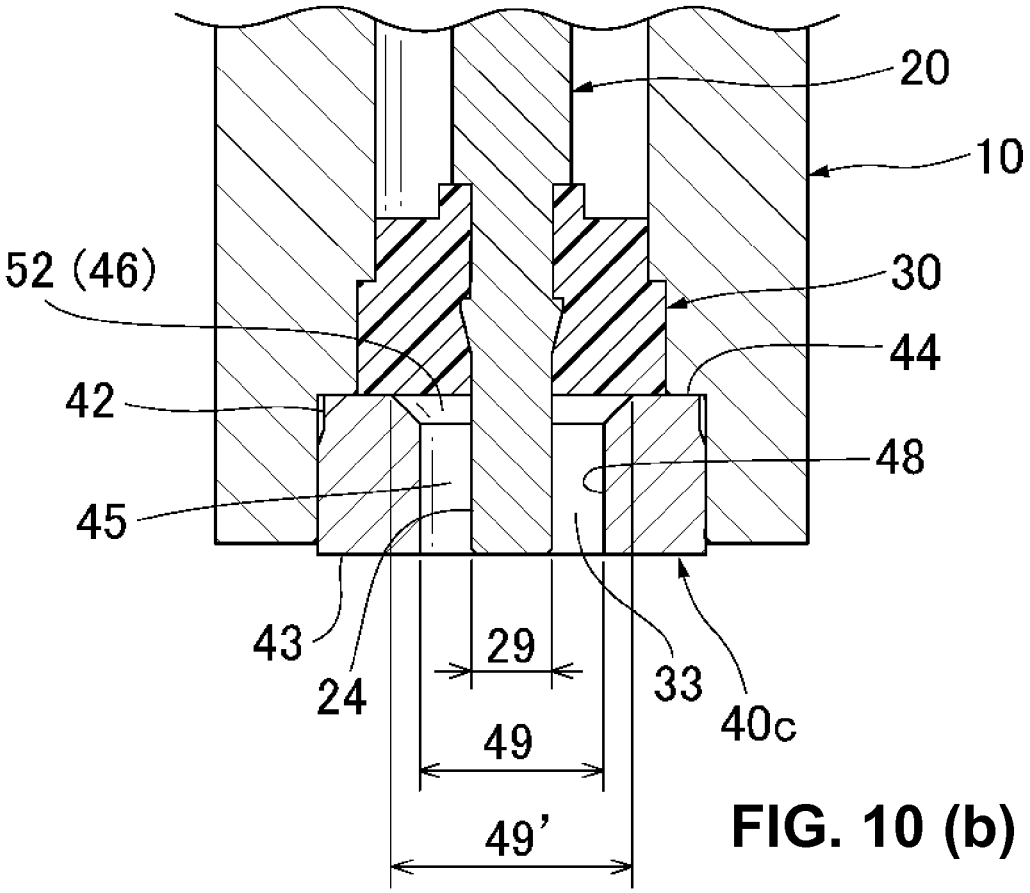

Using an annular metal member 40*c* shown in FIG. 10(*a*), simulation was conducted. FIG. 10(*b*) is a partial sectional view equivalent to FIG. 3 when the annular metal member 40*c* was used. Being different from those shown in FIGS. 1-3, in case of the annular metal member 40*c*, there is provided a tapered portion 52 on the inner circumferential surface 48 of the through hole 45, which extends from the facing surface 44 to the mounting surface 43 that is opposite the facing surface 44. Here, an inner diameter of the tapered portion 52 is set large from a side that is away from the facing surface 44 to a side close to the facing surface 44. As a result, the diameter 49' of the air layer 33 of the annular metal member 40*c* near the facing surface 44 is larger than the diameter 49 of the air layer 33 of the annular metal member 40*c* at a position that is away from the facing surface 44.

As shown in FIGS. 5 to 7, in this case, similarly to Examples 1 and 2, results were slightly better in any of the insertion loss, the voltage standing wave ratio, and the impedance, in comparison with those in FIGS. 1 to 3, in which the annular step portion is not provided. In addition, in this case, slightly better results were obtained in comparison with Example 1, but values were comparable to those in Example 2.

Example 4

Slit Configuration

Figure 11:
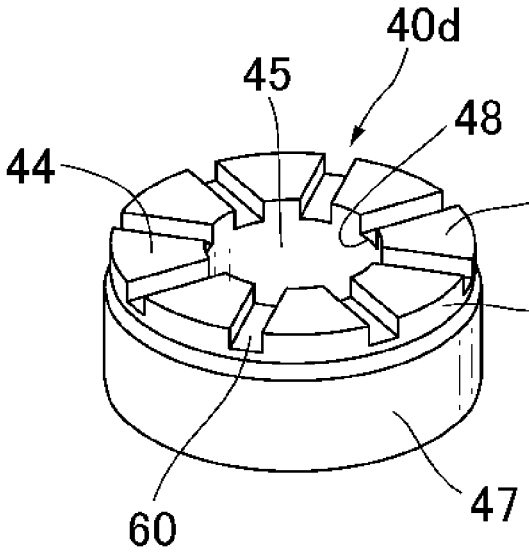
FIGS. 11(*a*) and 11(*b*) are views showing a configuration of a coaxial connector according to Example 4.
Figure 11:
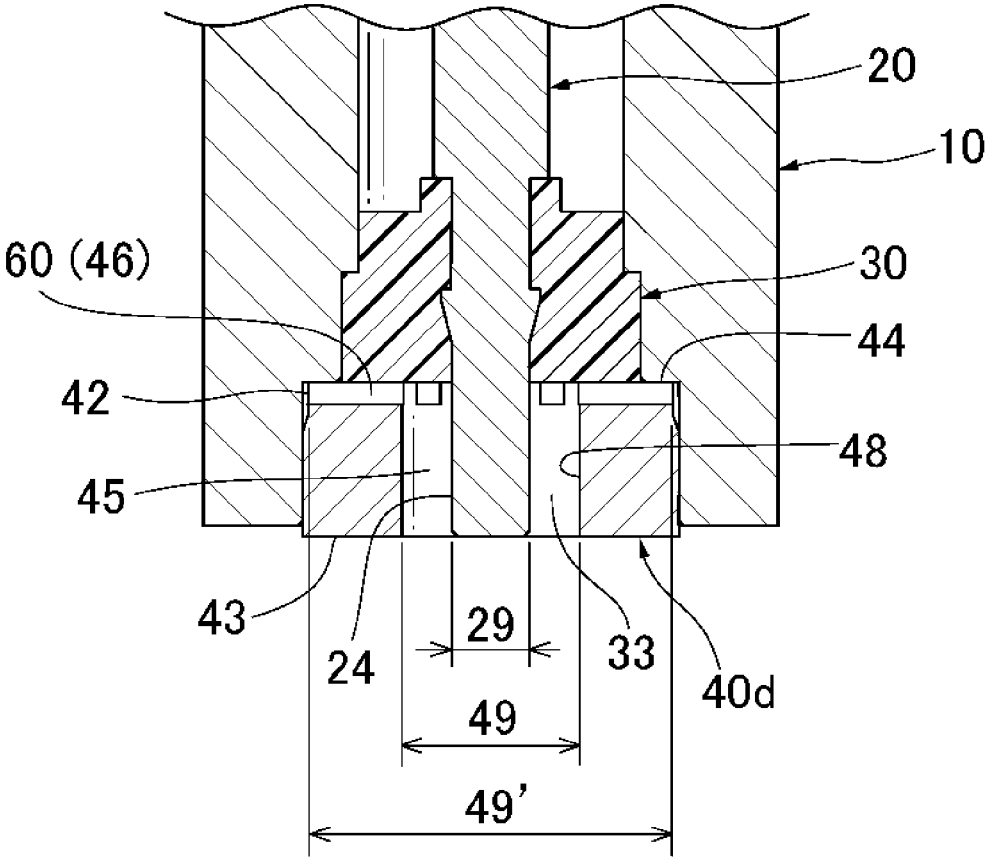

Using an annular metal member 40*d* shown in FIG. 11(*a*), simulation was conducted. FIG. 11(*b*) is a partial sectional view equivalent to FIG. 3 when the annular metal member 40*d* was used. Being different from those shown in FIGS. 1-3, the annular metal member 40*d* includes a plurality of groove portions (slits) 60 on the facing surface 44 from the center of the through hole 45 of the annular metal member 40*d* towards outside of the annular metal member 40*d*. Furthermore, the groove portions 60 are provided in plurality radially around the center of the through hole 45 of the annular metal member 40*d* at equal intervals. As a result, the diameter 49' at a certain part of the air layer 33 of the annular metal member 40*d* near the facing surface 44 is larger than the diameter 49 of the air layer 33 of the annular metal member 40*d* at a position away from the facing surface 44.

As shown in FIGS. 5 to 7, in this case, similarly to Examples 1 and 2, results are better than those of the configurations shown in FIGS. 1 to 3 in any of the insertion loss, the voltage standing wave ratio, and the impedance. However, in comparison with Examples 1 to 3, the results are slightly poor.

Comparative Example

Without Step-Like Structure

For a comparative example, using the annular metal member 40 shown in FIGS. 1 to 3, simulation was conducted. As in the Examples, the inner diameter of the annular metal member was not fabricated to have a special structure. Therefore, the diameter 49 of the air layer 33 of the annular metal member 40 near the facing surface 44 is equal to the diameter 49 of the air layer 33 of the annular metal member 40 at a position that is away from the facing surface 44.

As shown in FIGS. 5 to 7, in this case, only poor results than those in Examples 1 to 4 were obtained for any of the insertion loss, the voltage standing wave ration, and the impedance.

CONCLUSION AND DISCUSSION

As is obvious from FIGS. 5 to 7, in Examples 1 to 4, in which certain fabrication was applied to the annular metal members, better results were obtained in any of the insertion loss, the voltage standing wave ratio, and the impedance, in comparison with Comparative Example. Therefore, it is revealed that it is generally possible to obtain satisfactory results when the diameter 49 of the air layer 33 of the annular metal member 40*a* to 40*d* near the facing surface 44 is set larger than the diameter 49 of the air layer 33 of the annular metal member 40*a* to 40*d* at a position that is away from the facing surface 44.

High-frequency characteristics depend on an outer diameter of a central conductive member, an inner diameter of an outer conductive member, and permittivity of an insulating material provided between the central conductive member and the outer conductive member. Therefore, points where the inner diameter of the outer conductive member changes are considered as changing points of permittivity. Providing step-like structure or the like so as to enable forming an air layer, the permittivity of which is stable, the amount of change can be mild and mismatching of impedance was restrained.

Here, although details are not provided herein, similarly good results were obtained when embodiments of Examples 1 to 4 were employed in combination. Therefore, the scope of the present invention also includes all aspects in those variations, alterations, and modifications.

The disclosure of Japanese Patent Applications No. 2014-021311, filed on Feb. 6, 2014, is incorporated in the application by reference.

While the present invention has been explained with reference to the specific embodiments of the present invention, the explanation is illustrative and the present invention is limited only by the appended claims.

What is claimed is:

1. A coaxial connector, comprising:

an outer conductive member including a board mounting portion and a main body portion;

an insulation member disposed in the outer conductive member;

a central conductive member supported with the insulation member; and a metal member disposed in the outer conductive member below the insulation member, wherein said metal member includes a through hole for retaining the central conductive member therein, said central conductive member is situated in the through hole away from an inner surface of the through hole by a first distance at an upper portion of the through hole, said central conductive member is situated in the through hole away from the inner surface of the through hole by a second distance at a lower portion of the through hole, and said first distance is greater than the second distance.

2. The coaxial connector according to claim 1, wherein said metal member includes a step portion so that the central conductive member is situated away from the inner surface of the through hole by the first distance in the step portion.

3. The coaxial connector according to claim 1, wherein said metal member includes a plurality of step portions so that the central conductive member is situated away from the inner surface of the through hole by the first distance in at least one of the step portions.

4. The coaxial connector according to claim 1, wherein said metal member includes a tapered portion so that the central conductive member is situated away from the inner surface of the through hole by the first distance in the tapered portion.

5. The coaxial connector according to claim 1, wherein said metal member includes a plurality of groove portions so that the central conductive member is situated away from the inner surface of the through hole by the first distance in at least one of the groove portions.

6. The coaxial connector according to claim 5, wherein said groove portions are arranged to extend from a center of the through hole in a radial direction thereof.

7. The coaxial connector according to claim 1, wherein said central conductive member extends downwardly toward the board mounting portion beyond the metal member, and said central conductive member extends downwardly beyond the board mounting portion.

8. The coaxial connector according to claim 1, wherein said metal member includes a surface layer formed of a material having conductivity higher than that of a remaining portion of the metal member.

9. The coaxial connector according to claim 1, wherein said outer conductive member includes a first engaging portion for engaging with the insulation member and a second engaging portion for engaging with the metal member.

* * * * *